United States Patent [19]

Gach

[11] Patent Number: 4,572,389

[45] Date of Patent: Feb. 25, 1986

[54] TAMPER INDICATING SCREW CAP WITH SATELLITE RING

[75] Inventor: Peter P. Gach, Evansville, Ind.

[73] Assignee: Sunbeam Plastics Corporation, Evansville, Ind.

[21] Appl. No.: 668,513

[22] Filed: Nov. 5, 1984

[51] Int. Cl.[4] ..... B65D 41/34

[52] U.S. Cl. ..... 215/253

[58] Field of Search ..... 215/250, 252, 253

[56] References Cited

U.S. PATENT DOCUMENTS

| | | | |
|---|---|---|---|
| 3,747,793 | 7/1973 | Wassilieff | 215/250 |
| 3,874,540 | 4/1975 | Hidding | 215/252 |
| 4,355,730 | 10/1982 | Wiedmer | 215/253 |

*Primary Examiner*—Donald F. Norton

*Attorney, Agent, or Firm*—Fisher, Crampton, Groh and McGuire

[57] ABSTRACT

A tamper indicating closure for a container having a threaded neck includes a cup-shaped cap with internal threads and a substantially smooth exterior wall, the tamper indicating device taking the form of a satellite band which surrounds the cap and extends over a substantial portion of the height of the cap. The band is attached to the cap by a frangible connection. The satellite band covers so much of the side wall of the cap that it prevents gripping of the cap. When the cap has been sealed on a container and an attempt is made to open it, finger pressure applied to the band to reach removal torque will fracture the frangible connection between the band and cap. Also attempts to pull the band off the cap will break the frangible connection. Once the band has been removed from the cap the closure may be opened and closed in the conventional manner. The cap and band may be molded in one piece with the intermediate frangible flange or it may be molded as a separate satellite band assembly with an annular flange which will slip over the cap and snap into place by engagement with lugs formed on the cap. The satellite band may be snapped onto the cap body before or after capping. If the cap is pre-assembled, then on-drive lugs can be provided on the top of the cap to provide means for the initial closing.

17 Claims, 8 Drawing Figures

TAMPER INDICATING SCREW CAP WITH SATELLITE RING

This invention relates to closures for containers and more particularly to a conventional screw type closure having means to indicate tampering.

There are a large variety of closures for containers which attempt to either give evidence that the container has been tampered or opened or that the container remains in a sealed or unopened condition once it has been filled. The purpose of such closures is to insure that the consumers can be confident that a closure has remained in a closed condition once it has been filled and that it has not been tampered with prior to purchase.

It is a general object of this invention to provide a tamper indicating closure which does not require a special container and can therefore be used on a wide variety of containers of standard configuration.

It is another object of this invention to provide a tamper indicating satellite band which surrounds a conventional screw cap which band prevents the user from exerting an opening force directly on the main body of the cap.

It is still another object of this invention to provide a conventional screw type cap with a surrounding tamper indicating satellite band which will fracture away from the main cap body upon the use of finger pressure on the band in an attempt to open the cap closure.

It is yet another object of this invention to provide a standard screw type cap closure with a tamper indicating satellite band which can be formed as a unitary structure or as a two piece structure in which the band can be applied to the cap before or after sealing the cap to a container.

The objects of the invention are accomplished by a tamper indicating closure which is adapted for use with a container having a standard threaded neck, requiring no additional modification to the container to provide the tamper indication. The cap is a generally cup-shaped cap having an annular side wall with a substantially smooth exterior wall and a threaded interior wall for engaging the complementary threads on the neck of the container. A tamper indicating satellite band is placed around the cap in spaced relationship to the cap and extending over substantial portion of the height of the cap so that the cap may not be directly grasped for untightening. The tamper indicating band is attached to the cap by a frangible connection so that upon application of finger pressure to the band in an opening direction, the band will be broken away from the cap body. This fracture of the band away from the cap body clearly indicates that tampering or an initial opening has taken place. Once this fracture has served its purpose, the entire band and frangible connection can be completely removed from the main body of the cap so that the cap may be used in its conventional manner for opening and closing its associated container. Typically the band is supported by a flange which connects the band to the exterior wall of the cap. This flange may be continuous or discontinuous and composed of a plurality of equally spaced flange members. Likewise the frangible connection may be continuous in the form of a reduced cross-section of the flange member or the flange might be reduced to the point where it comprises a plurality of equally spaced frangible bridge members connecting the band to the exterior cap wall. When the closure is made with two pieces, an inwardly directed flange member has a frangible connection where the flange joins the band. The cap has formed on its exterior wall cooperating pairs of upper and lower lugs over which the flange of the band may be snapped into place, thus retaining the tamper indicating satellite band assembly in a nonrotational relationship to the cap. With the two piece structure, the tamper indicating band assembly may be snapped onto the cap before or after the cap has been sealed to its closure. Where it is desired to assemble the satellite band assembly to the cap prior to sealing the cap to the container, "on-only" drive lugs may be provided on the top surface of the cap to permit the cap to be tightened to the container without damage to the satellite band. With a one piece structure means are also provided to apply the cap to the container without breakage of the satellite band.

The presently preferred embodiments are illustrated in the accompanying drawing in which.

Figure 7:
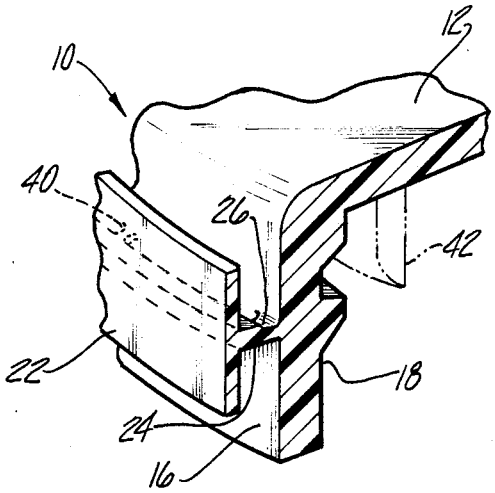
FIG. 7 is a fragmentary perspective view in section showing the satellite band and cap as a unitary structure.

A tamper indicating closure embodying the invention is designated generally at 10 and is adapted for use with a container (not shown) having a standard threaded neck. Closure 10 can be molded in one piece as shown in FIG. 7 or in two pieces as shown in FIGS. 1, 2, 4 and 5.

Figure 1:
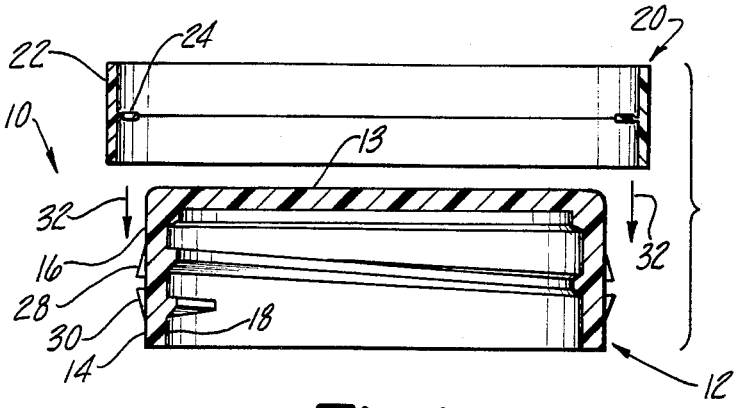
FIG. 1 is an exploded elevational view in cross-section showing a separate satellite band assembly and a cap embodying the invention.
Figure 2:
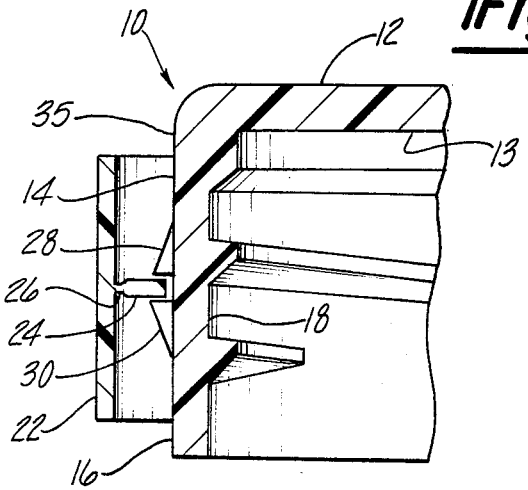
FIG. 2 is a fragmentary sectional view on an enlarged scale showing the satellite band assembly attached to the cap.
Figure 5:
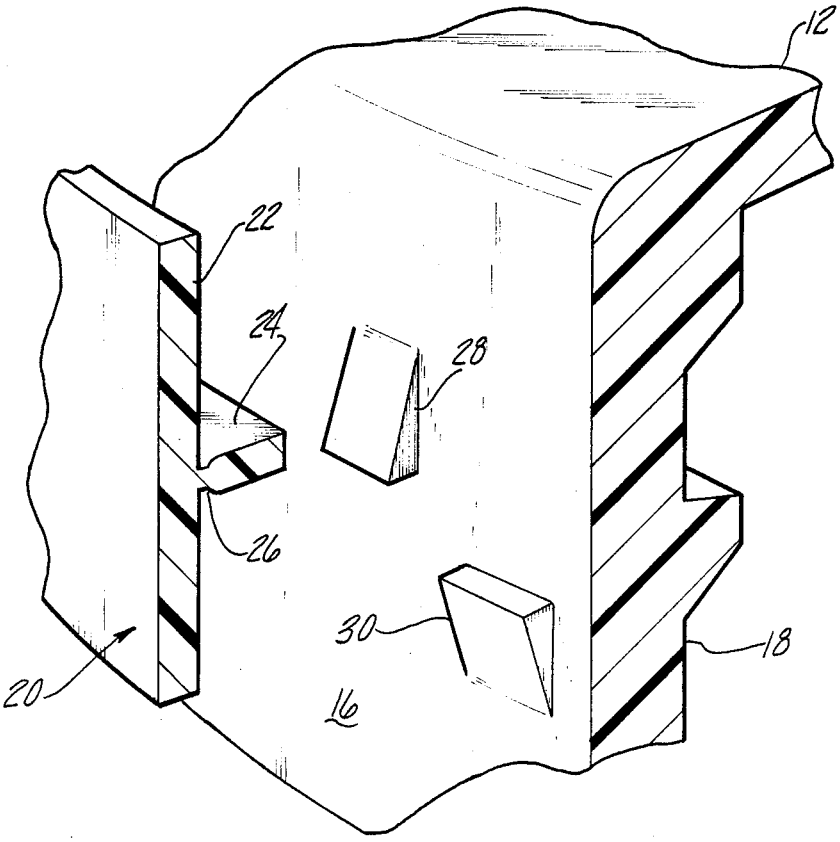
FIG. 5 is a fragmentary perspective view partially in section showing on an enlarged scale the connection of the satellite band to the cap.

Referring to FIGS. 1 and 2, closure 10 is shown in its two piece form including a cup-shaped cap 12 having a flat top 13 and an annular side wall 14 with a substantially smooth exterior wall 16 and a threaded interior wall 18. The second piece of the two piece closure is a tamper indicating satellite band assembly 20 which consists of a thin annular band 22 having an integrally formed radially inwardly directed flange 24. As shown in FIGS. 2 and 5, flange 24 has a reduced cross-section forming a frangible connection 26 where it joins band 22. Flange 24 may be a continuous annular flange or it may be divided into a plurality of equally spaced flange members. Likewise, frangible connection 26 may be continuous or it may be a series of equally spaced frangible connection points. A series of upper lugs 28 and lower lugs 30 are formed on exterior cap wall 16 in a plurality of equally spaced associated pairs. Lugs 28 and 30 are separated vertically by a distance to accommodate the thickness of flange 24 and they are separated circumferentially so as to be adjacent but not directly in line to further accommodate flange 24. Upper lugs have a ramp surface diverging outwardly as they extend down, and lower lugs have a ramp surface diverging outwardly as they extend upward, see FIG. 5. As shown in FIG. 1 by arrows 32, band assembly 22 is slipped over top 14 of cap 12, and flange 24 slides down the ramp surface on upper lugs 28 to snap into position between pairs of upper lugs 28 and lower lugs 30.

When cap 12 is tightened or sealed on a container with the tamper indicating satellite band in position, there is insufficient exposed exterior wall 16 to grasp when seeking to remove closure 10 from the container. The user must, therefore, grasp band 22 in order to remove closure 10 from its assembled container. When sufficient finger pressure is exerted on band 22 to overcome the closure torque, the frangible connection 26 will break as clearly shown in FIG. 4 where arrows 34 indicate the application of finger pressure to establish an opening torque on cap 12. The fracture of connection 26 breaks band 22 away from flange 24. This clearly indicates that tampering of closure 10 has taken place, that is, opening force has been applied. The severed band 22 and flange 24 can be easily removed so that the closure will function in a normal fashion during repeated opening and closing.

Figure 3:
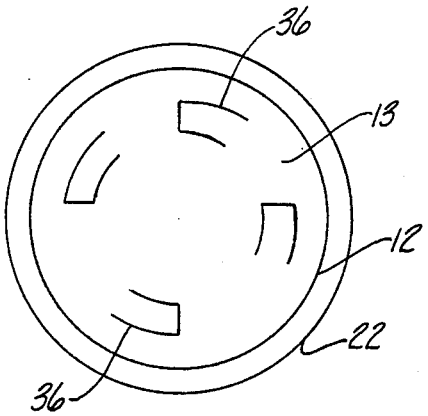
FIG. 3 is a top plan view of the assembly showing on-drive lugs formed in the top of the cap.
Figure 4:
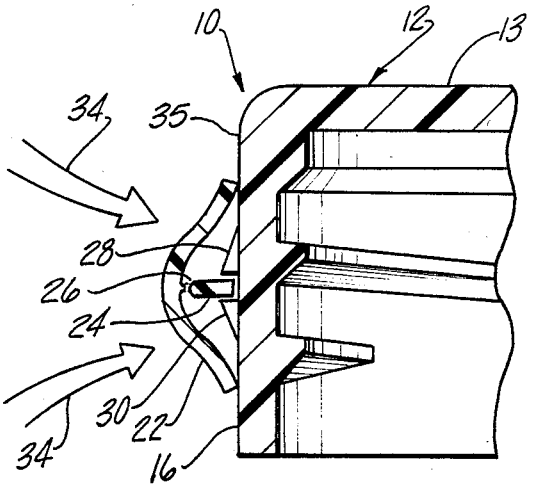
FIG. 4 is a fragmentary sectional view similar to FIG. 2 showing rupture of the frangible connection upon application of force to the tamper indicating band.
Figure 6:
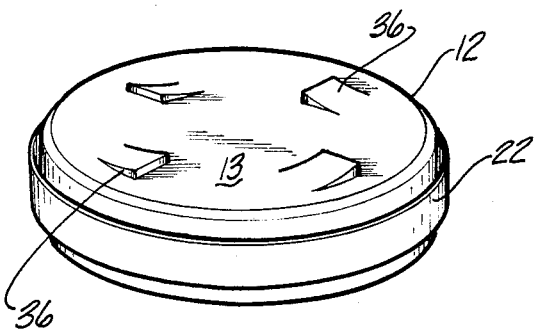
FIG. 6 is a perspective view showing the on-drive lugs formed on the top of the cap as indicated in FIG. 3.

Satellite band 20 can be snapped onto cap 12 after the cap has been firmly closed on a container; in which case closure 10 is in condition for its intended purpose, that is, to indicate tampering or first opening of the closure by breaking of band 22 away from its associated flange 24. In some packaging procedures it may be desirable to assemble band assembly 20 to cap 12 prior to the application of the closure 10 to the container. In this case, special tooling in the form of a chuck may be necessary to grasp the small exposed top area 35 of exterior side wall 16 so as not to fracture the frangible connection 26 of band assembly 20—see FIG. 2. Another expedient is shown in FIGS. 3 and 6 where on-only drive lugs 36 are formed integrally with cap top 13. Four equally spaced drive lugs 36 are shown with ramps that allow only tightening, clockwise, torque to be applied to the cap with a suitable wrench.

Referring to FIG. 7, closure 10 is shown in its one piece form in which band 22, flange 24 and frangible connection 26 are all molded integrally with cap 12. Here the frangible connection, in the form of a reduced cross-section of flange 24, is shown at the point where flange 24 connects to the main body of exterior side wall 16. This closure 10 functions in the same manner as two piece closure 10 shown in FIGS. 1 and 2 in that any finger pressure applied to band 22 which is sufficient to create an opening torque will first fracture the frangible connection 26 breaking band 22 and flange 24 away from cap 12. FIG. 7 also shows that the frangible connection may be discontinuous around the periphery of the cap as shown by an individual frangible connection of reduced cross-section at 40. FIG. 7 also shows that cap 12 may be supplied with a conventional plug seal shown in phantom at 42.

Figure 8:
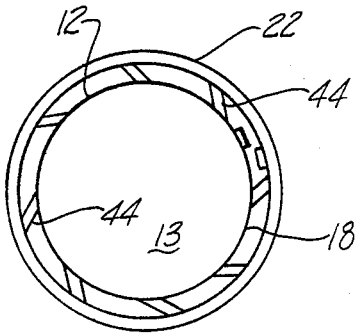
FIG. 8 is a top view showing another embodiment of the invention.

FIG. 8 shows another embodiment of a one piece structure where the tamper indicating satellite band 22 has been formed integrally with cap 12. Here a plurality of angled struts 44 have been substituted for flange 24 and frangible connection 26. Struts 44 join band 22 to exterior wall 16 of cap 12 at an angle such that when a tightening or closing, clockwise, torque is applied to the band 22, the cap 12 will be tightened onto is container without fracture of strut members 44. Once cap 12 has been tightened onto a container and an opening, counterclockwise, torque is applied to band 22, the struts 44 will fracture and separate from wall 18 indicating tampering or initial opening of the closure. Likewise, as in other embodiments, any lifting force applied to band 22 will also fracture the struts 44 away from side wall 18.

It can be seen from the foregoing examples of the preferred embodiments of the invention that the tamper indicating band can be applied to any conventional screw cap which is tightened onto a container with sealing torque such that upon the application of an opening torque to the band 22 the frangible connection 26 will be broken prior to any opening. In some instances closing torque and hence opening torque is increased by the use of such devices as lock threading and the like. Also, a plug seal such as that illustrated at 42 in FIG. 7 provides such an increased torque value. When the closure 10 is made in two pieces, the tamper indicating satellite band assembly 20 can be made of a weaker or more brittle material to lower its fracture point, while the cap may be made of material to provide a slippery exterior surface 14. Also with a two piece structure the tamper indicating band 20 can be made from a contrasting color.

The embodiments of the invention in which an exclusive property or privilege is claimed are defined as follows:

1. A tamper indicating closure for a container having a threaded neck, comprising, in combination:
   - a cup-shaped cap having an annular side wall with a substantially smooth exterior wall and a threaded interior wall for engaging complementary threads on the neck of said container;
   - a tamper indicating satellite band circumposing said cap, said band being spaced from and extending over a substantially more than half the height of said cap; and
   - an annular flange member integrally molded with said band and connected to the exterior of said cap at a mid-point thereof and forming a frangible connection adapted to be broken by finger pressure when the cap is grasped to assert an opening force thereon.

2. The tamper indicating closure of claim 1 wherein said flange member is discontinuous.

3. The tamper indicating closure of claim 2 wherein said flange member comprises of plurality of equally spaced flanges.

4. The tamper indicating closure of claim 1 wherein said flange member has a reduced cross-section which serves as a frangible connection between said tampering indicating band and said cap.

5. The tamper indicating closure of claim 4 wherein said reduced cross-section is located adjacent the point where said flange connects to said band.

6. The tamper indicating closure of claim 4 wherein said reduced cross-section is located adjacent the point where said flange connects to exterior of said cap.

7. The tamper indicating closure of claim 1 wherein said flange member is connected to said band at a plurality of frangible connection points.

8. The tamper indicating closure of claim 1 wherein said satellite band and said annular flange member is formed integral with said cup-shaped cap to form a one piece closure.

9. A tamper indicating closure for a container having a threaded neck, comprising, in combination:
   - a cup-shaped cap having an annular side wall with a substantially smooth exterior wall and a threaded interior wall for engaging complementary threads on the neck of said container, said cap having a plurality of equally spaced circumferentially disposed retaining lugs on the exterior wall thereof;

a tamper indicating satellite band assembly adapted to circumpose said cap, said band assembly including a tamper indicating band having a width adapted to extend over a substantial portion of a height of said cap, and an annular flange connected to said band by frangible connection means and being adapted for retention by said lugs to maintain said band in spaced relationship to said cap.

10. The tamper indicating closure of claim 9 wherein said frangible connection means comprises a plurality of equally spaced bridges connecting said flange to said band.

11. The tamper indicating closure of claim 9 wherein said cap has means for tightening said cap on said container after said tamper indicating satellite band assembly has been assembled to said cap.

12. The tamper indicating closure of claim 11 wherein said means for tightening said cap on said closure includes a plurality of equally spaced on-drive lugs formed integrally on the top of said cap.

13. The tamper indicating closure of claim 11 wherein the means for tightening said cap on said container includes sufficient area on said exterior wall adjacent the top of said cap which is unobstructed by said satellite band assembly to permit engagement with a tigthening tool.

14. A tamper indicating closure for a container having a threaded neck, comprising, in combination:

a cup-shaped cap having an annular side wall with a substantially smooth exterior wall and a threaded interior wall for engaging complementary threads on the neck of said container, said cap having a plurality of pairs of opposed retaining lugs equally spaced around the circumference of said exterior wall;

a tamper indicating satellite band having an integrally molded annular flange member engaging said pairs of opposed retaining lugs and holding said band circumposing said cap, spaced from and extending over a substantial portion of the height thereof; and said annular flange member presenting a frangible connection between said band and exterior of said cap adapted to be broken by finger pressure when the cap is grasped to assert an opening force thereon.

15. The tamper indicating closure of claim 14 wherein said opposed retaining lugs of each pair are offset circumferentially from each other.

16. The tamper indicating closure of claim 14 wherein each said pair of lugs comprises an upper and lower lug, the upper lug having a downwardly and outwardly extending ramp to facilitate assembly of said band and flange to said cap.

17. The tamper indicating closure of claim 14 wherein the top of said cap has a plurality of equally spaced on-drive lugs for tightening said cap on said container after said band and flange member have been assembled to said cap.

* * * * *